United States Patent [19]

Armstrong

[11] Patent Number: 4,775,157

[45] Date of Patent: Oct. 4, 1988

[54] GAME USING CARDS AND CARDS THEREFORE

[76] Inventor: Thomas E. Armstrong, P.O. Box 524, Verona, Miss. 38879

[21] Appl. No.: 52,907

[22] Filed: May 22, 1987

[51] Int. Cl.[4] ..... A63F 1/00

[52] U.S. Cl. ..... 273/299

[58] Field of Search ..... 273/299

[56] References Cited

U.S. PATENT DOCUMENTS 742,493 10/1903 Roy ..... 273/299
1,191,419 7/1916 Harrison ..... 273/299
1,542,819 6/1925 Bloom ..... 273/299
1,551,680 9/1925 Meissner ..... 273/299

*Primary Examiner*—Anton O. Oechsle
*Attorney, Agent, or Firm*—Alexander F. Norcross

[57] ABSTRACT

A deck of playing cards having fifty-two cards consisting of varying numbers of the letters b, i, n, g, and o in three suit colors is shown. The cards are used in a card game which combines the random dealing of a fixed number of cards and discard and draw of a variable number of cards to maximize the spelling of a specific word with increased points for all letters in the same color and partial points for a partial spelling of the word.

1 Claim, 2 Drawing Sheets

GAME USING CARDS AND CARDS THEREFORE

BACKGROUND OF THE INVENTION

This invention relates to an improvement in card games and particularly relates to a novel type of playing card, in a deck of such cards which provides a specific and unique card game and word game of enhanced chance and difficulty over the standard game of poker.

Word building games utilizing playing cards are known in the prior art. Such games involve the use of letters on cards to form predetermined words or to allow a player to form his own words. Such games are depicted in U.S. Pat. No. 4,219,197, and the patent cited therein, all involving decks of cards having letters thereupon to be used in variety of word games.

U.S. Pat. No. 4,219,197 shows a deck of cards having the four standard poker suits coupled with a series of letter designations and row indicia to adapt the standard draw poker game to that of a word component game.

A second form of such card games is shown in U.S. Pat. Nos. 118,977 and 563,619 showing cards having letters utilized as scoring or positional indicia rather than to spell words.

SUMMARY OF THE INVENTION

I disclose a deck of cards designed for the spelling or partial spelling of a specific word, in the proposed embodiment Bingo.

Unlike the prior art in which the letters and suits are symmetrically distributed across a deck of cards to achieve fifty-two cards, I show a fifty-two card deck of size suitable to play by dealing fixed size hands of cards but having a unique and non-symmetrical distributions of letters between suits and colors.

The game is scored by providing for a higher score for the achievement of a full spelling of the word in a single colored suit, a lower score for the spelling in a more common colored suit, a lower score for a multi-suited spelling, and partial scoring for partial hand. In addition, I provide two wild cards or jokers which may be used to substitute for any letter or color in order to increase the score of the hand.

In summary, I show a game in which the play of the hand for the particular unique card deck shown is nonobvious and somewhat subtle to the player who must select from a dealt hand a fixed number of cards so as to maximize the player's score as against other players.

In addition, the non-symmetrical and unique distribution I show in the hand of cards increases the skill required for counting the hand and determining the probability and thus increases the skill required for the play of the game.

DETAILED DESCRIPTION OF THE PREFERRED EMBODIMENT

Figure 1:
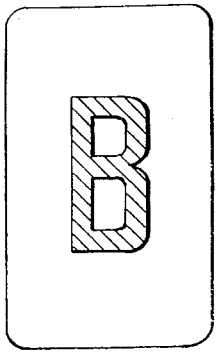
FIGS. 1 through 15 show the fixed cards having thereupon respectively the letters B, I, N, G, and O and being in the colors of red, green, or blue.
Figure 2:
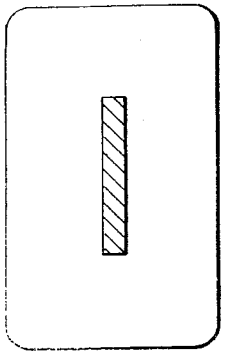
Figure 3:
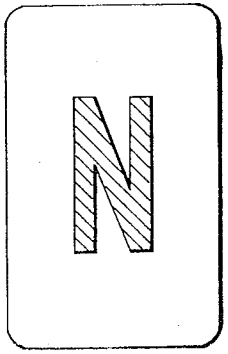
Figure 4:
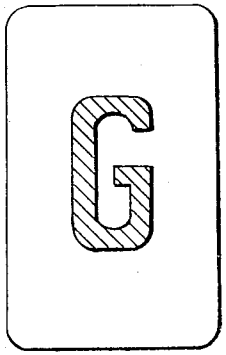
Figure 5:
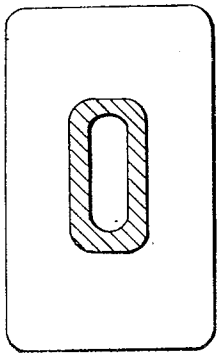
Figure 6:
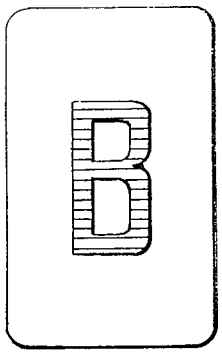
Figure 7:
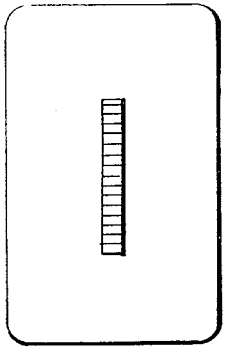
Figure 8:
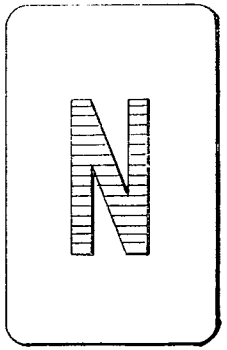
Figure 9:
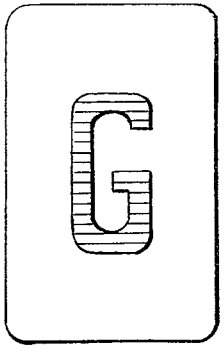
Figure 10:
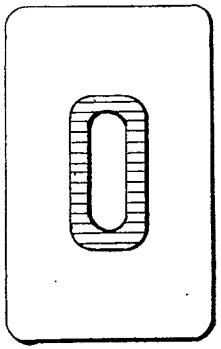
Figures 11, 12, 13, 14, 15:
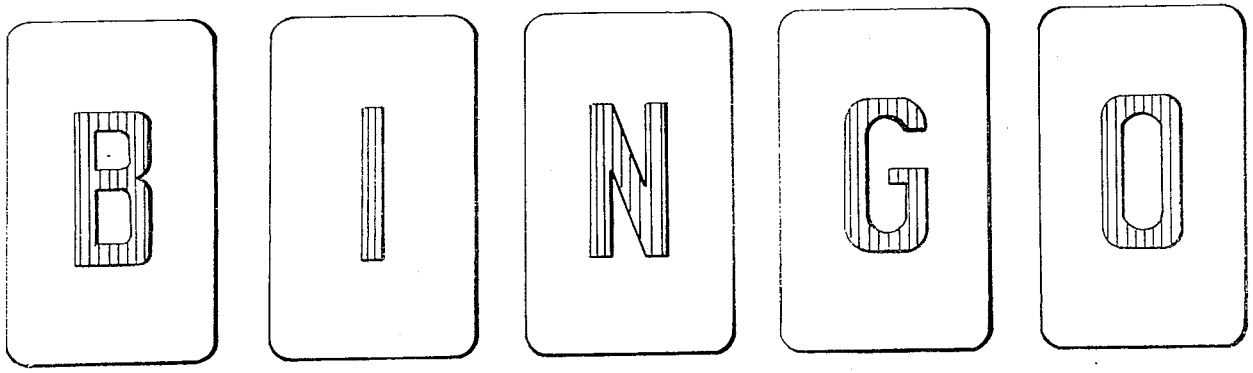

Referring to the figures I provide a deck of fifty-two cards, comprising on the face of the cards the five letters, B, I, N, G, and O, each of said letters being in one of three colors, preferably red, green, or blue.

I make these cards into a deck of fifty-two cards by providing the following number of cards to-wit:

Of red letters I provide five B's, three I's, four N's, four G's, and four O's, being a total of twenty red cards.

Of the green cards I provide four B's, three I's, four N's, two G's, and two O's, being a total of fifteen green cards.

Of the blue cards I provide four B's, three I's, four N's, two G's, and two O's, again being a total of fifteen cards.

I provide, therefore, in total thirteen B's, nine I's, twelve N's, eight G's, and eight O's and then include two wild cards which may be in the form of any standard joker for a total deck of fifty-two cards.

In the play of the cards, the deck of cards is shuffled as a standard deck and dealt in sequence to the players to provide each player with seven cards face down. Once the seven cards have been dealt then each player is to individually sort and select, among the seven cards dealt, five cards to provide the best hand according to the following scoring:

A combination spelling "BINGO" which is either all green or all blue counts fifty points. A combination spelling "BINGO" which is all red will count forty points. A combination spelling "BINGO" but in multiple colors (two or more colors) would count thirty points. If no combination of the cards will completely spell "BINGO" then the points of the hand would be counted by placing in consecutive order the B, I, N, and then a G. Each such card in sequence would count five points. The cards must be in sequence, however, and no points are counted for cards which do not succeed prior cards in the sequence B, I, N, and G.

Obviously, if the hand has B, I, N, G, and O in it, then the hand will count thirty or more points.

For example, a hand containing the cards, B, I, N, N, and N would count 15 points. A hand containing B, I, G, G, and O would count 10 points. A hand containing I, N, G, O, and O would count no points as it is not in sequence.

The two wild cards may be used to count for any card or any color and thus may be introduced into a nearly complete hand to complete it for a maximum score. Thus, in a hand containing the letters B, I, N, G, and O four letters of which are in one color and one letter of which is in a second color would normally be a thirty point hand; however, if it contains a wild card, the wild card may be substituted for the letter card of the second color and would then count as a B, I, N, G, and O spelt in a single color being thus a forty or fifty point hand. Similarly, a wild card may be used to extend a partial score of a hand or to substitute for a missing card so as to permit the completion of the spelling of BINGO.

It should be seen that the non-symmetrical distribution of letters and colors provide for an unusual probability distribution, supporting the differential scoring. The lesser number of I's and O's decreases the probability of a complete spelling of BINGO and also changes the probability of partial scores. It can thus be seen that the specific card game described in claim below is of a unique type, providing for an unusual and interesting line of play.

I claim:

1. A card deck adapted for playing a game of cards comprising, in playing cards of a usual shape adapted for holding in the hand, a card deck having face cards consisting of fifty-two cards consisting of:

a. Five cards having thereupon the letter B in red;
b. Three cards having thereupon the letter I in red;
c. Four cards having thereupon the letter N in red;
d. Four cards having thereupon the letter G in red;
e. Four cards having thereupon the letter O in red;
f. Four cards having thereupon the letter B in blue;
g. Three cards having thereupon the letter I in blue;
h. Four cards having thereupon the letter N in blue;
i. Two cards having thereupon the letter G in blue;
j. Two cards having thereupon the letter O in blue;
k. Four cards having thereupon the letter B in green;
l. Three cards having thereupon the letter I in green;
m. Four cards having thereupon the letter N in green;
n. Two cards having thereupon the letter G in green;
o. Two cards having thereupon the letter O in green; and
p. Two cards having thereupon a joker figure signifying a wild card.

* * * * *